US012674217B2

(12) United States Patent
Asai

(10) Patent No.: US 12,674,217 B2
(45) Date of Patent: Jul. 7, 2026

(54) MOTOR CORE PRODUCTION METHOD AND HEAT TREATMENT DEVICE USED THEREFOR

(71) Applicant: DAIDO STEEL CO., LTD., Nagoya (JP)

(72) Inventor: Koichiro Asai, Nagoya (JP)

(73) Assignee: Daido Steel Co., Ltd., Nagoya (JP)

( * ) Notice: Subject to any disclaimer, the term of this patent is extended or adjusted under 35 U.S.C. 154(b) by 521 days.

(21) Appl. No.: 18/097,936

(22) Filed: Jan. 17, 2023

(65) Prior Publication Data

US 2023/0235422 A1 Jul. 27, 2023

(30) Foreign Application Priority Data

Jan. 21, 2022 (JP) ..... 2022-008231

(51) Int. Cl.
*C21D 9/00* (2006.01)

(52) U.S. Cl.
CPC ..... *C21D 9/0056* (2013.01); *C21D 9/0062* (2013.01)

(58) Field of Classification Search
CPC ..... C21D 9/0056; C21D 9/0062; C21D 1/26; C21D 1/74; C21D 1/76; C21D 6/00; C21D 8/12; C21D 8/1244; C21D 8/1272; C21D 9/0068; C21D 9/46; C21D 9/561; C21D 9/563; C21D 9/573; C21D 9/67; C21D 9/0081; H02K 15/02; C23C 8/26
USPC ..... 266/249; 29/596, 598
See application file for complete search history.

(56) References Cited

U.S. PATENT DOCUMENTS

| | | | | |
|---|---|---|---|---|
| 5,402,994 | A | 4/1995 | Egger | |
| 5,948,180 | A * | 9/1999 | Tomida | C21D 8/12 310/216.006 |
| 10,199,910 | B2 * | 2/2019 | Liang | H02K 15/02 |
| 10,554,107 | B2 * | 2/2020 | Takahashi | H02K 1/27 |
| 10,718,569 | B2 * | 7/2020 | Tomita | D03D 1/00 |
| 10,879,777 | B2 * | 12/2020 | Rong | H02K 1/12 |
| 11,279,985 | B2 * | 3/2022 | Natori | C22C 38/60 |

(Continued)

FOREIGN PATENT DOCUMENTS

| | | |
|---|---|---|
| DE | 102009042124 A1 | 4/2010 |
| DE | 102022115094 A1 | 6/2023 |

(Continued)

OTHER PUBLICATIONS

German Office Action dated Nov. 24, 2025 in German Patent Application No. 102023101361.0 with machine English translation.

*Primary Examiner* — Jessee R Roe
*Assistant Examiner* — Michael Aboagye
(74) *Attorney, Agent, or Firm* — McGinn IP Law Group, PLLC

(57) ABSTRACT

The present invention relates to a motor core production method including: a preparation step of preparing a laminate of electromagnetic steel sheets each processed into a predetermined shape; a first heating step of heating the laminate at an atmospheric temperature of 500° C. to 800° C. in an atmospheric gas comprising at least one kind selected from the group consisting of a low oxidizing gas and a reducing gas, and having a dew point of −20° C. or lower; and a second heating step of soaking the laminate at 1,000° C. to 1,200° C. in a vacuum of 100 Pa or less after the first heating step, and a heat treatment device for performing the production method.

18 Claims, 8 Drawing Sheets

(56) References Cited

U.S. PATENT DOCUMENTS

| | | | |
|---|---|---|---|
| 2010/0068669 | A1 | 3/2010 | Ishimoto |
| 2016/0053359 | A1 | 2/2016 | Heuer |
| 2016/0258034 | A1 | 9/2016 | Kozono et al. |
| 2022/0199304 | A1 | 6/2022 | Volbers |

FOREIGN PATENT DOCUMENTS

| | | | |
|---|---|---|---|
| EP | 0621904 | B1 | 7/1993 |
| EP | 2986751 | B1 | 2/2016 |
| JP | H04-332384 | A | 11/1992 |
| JP | 2016-161243 | A | 9/2016 |

* cited by examiner

MOTOR CORE PRODUCTION METHOD AND HEAT TREATMENT DEVICE USED THEREFOR

CROSS-REFERENCE TO RELATED APPLICATIONS

This application is based on and claims priority under 35 USC 119 from Japanese Patent Application No. 2022-008231 filed on Jan. 21, 2022, the contents of which are incorporated herein by reference.

TECHNICAL FIELD

The present invention relates to a motor core production method and a heat treatment device used therefor.

BACKGROUND ART

A motor core such as a rotor core or a stator core is produced by punching a strip-shaped electromagnetic steel sheet into a predetermined shape by press processing and laminating the steel sheets having the predetermined shape. Here, processing strain occurs during press punching, caulking processing in lamination, and the like. It is known that when the motor core is produced with this processing strain remaining, a magnetic path is strained, and a motor cannot exhibit performance as designed. Therefore, an attempt is made to reduce processing strain by annealing a laminate of electromagnetic steel sheets (see, for example, Patent Literature 1).

Patent Literature 1: JP2016-161243A

SUMMARY OF INVENTION

In order to obtain a motor core having excellent magnetic properties, it is considered effective to grow crystal grains of the electromagnetic steel sheet such that the gain size is 100 μm or more. However, under conditions of strain relief annealing in the related art, there is a problem that an annealing temperature is low and grain growth can be expected only to a small degree. Although it is considered to use a steel sheet that has been adjusted to a desired crystal grain size by a heat treatment or the like in advance, a material procurement cost increases, Under the background of the above circumstance, an object of the present invention is to provide a motor core production method capable of performing strain relief and grain growth in a laminate at the same time, and a heat treatment device used therefor.

Namely, the motor core production method of first aspect of the present invention is defined as follows.

A motor core production method including:

- a preparation step of preparing a laminate of electromagnetic steel sheets each processed into a predetermined shape;
- a first heating step of heating the laminate at an atmospheric temperature of 500° C. to 800° C. in an atmospheric gas including at least one kind selected from the group consisting of a low oxidizing gas and a reducing gas, and having a dew point of −20° C. or lower; and
- a second heating step of soaking the laminate at 1,0000° C. to 1,200° C. in a vacuum of 100 Pa or less after the first heating step.

According to the motor core production method of the first aspect defined in this way, through a series of heat treatments including the first heating step and the second heating step, the laminate is heated to a temperature (1,000° C. to 1,2.00° C.) at which grain growth can be performed in a short period of time, so that strain relief and grain growth in the laminate can be performed at the same time.

In addition, in the motor core production method of the first aspect, the laminate is heated in two stages, that is, convection heat transfer heating by using an atmospheric gas and subsequent vacuum heating, and the laminate can be efficiently heated to a temperature at which grain growth can be performed while oxidation of the laminate is prevented.

Here, in the temperature range of 1,000° C. to 1,200° C., rigidity of the laminate during the treatment is lowered and a shape thereof is likely to change. Therefore, it is desirable that the laminate is heat-treated in a state of being placed on a jig made of a C/C composite (second aspect).

In addition, the low oxidizing gas can be nitrogen gas, and the reducing gas can be at least one kind selected from the group consisting of hydrogen gas and carbon monoxide gas (third aspect).

As described above, according to the motor core production method of the present invention, strain relief and grain growth in the laminate can be performed at the same time. Therefore, an average crystal grain size of each of the electromagnetic steel sheets before the first heating step can be less than 100 μm (fourth aspect), and with grain growth of this, the average crystal grain size of each of the magnetic steel sheets after the second heating step can be 100 μm to 300 μm (fifth aspect).

The average crystal grain size of each of the electromagnetic steel sheets constituting the laminate is measured as follows. A test piece is cut such that a thickness cross section can be observed, and grain boundaries are corroded and expressed by Nital etching. Thereafter, the crystal grain sizes of 100 or more crystal grains are measured by a line segment method to obtain the average crystal grain size.

The heat treatment device of the sixth aspect of the present invention is defined as follows.

A roller hearth type heat treatment device for performing the production method according to the first aspect, the heat treatment device including:

- a plurality of heat treatment chambers configured to heat the laminate; and
- a roller disposed in each of the heat treatment chambers and configured to support and transport the laminate, wherein
- the plurality of heat treatment chambers comprises a first heating chamber performing the first heating step, a second heating chamber performing the second heating step, and an annealing chamber annealing the laminate after the second heating step, and
- the first heating chamber, the second chamber and the annealing chamber are disposed in series.

The heat treatment device of the seventh aspect of the present invention is defined as follows.

A heat treatment device for performing the production method according to the first aspect, the heat treatment device including:

- a transport track;
- a batch-type heating chamber disposed along the transport track and configured to perform at least one of the first heating step and the second heating step;
- a batch-type cooling chamber disposed along the transport track and configured to anneal the laminate after the second heating step; and
- a transport unit including a temperature-retaining chamber configured to house a target object and retain a temperature of the target object by a heater, and a transfer chamber configured to transfer the laminate between the heating chamber and the temperature-retaining chamber and between the cooling chamber and the temperature-retaining chamber.

The motor core production method according to the first aspect can also be performed in the heat treatment device according to the seventh aspect defined in this way.

DESCRIPTION OF EMBODIMENTS

Next, an embodiment of the present invention will be described in detail below.

A motor core production method according to an embodiment of the present invention can be performed as one step of producing a motor core such as a rotor core or a stator core. A laminate S constituting a motor core is formed by laminating steel sheets each having a predetermined shape obtained by punching strip-shaped electromagnetic steel sheet by press processing in a separate step (not shown) and combining the steel sheets by caulking processing or the like.

Figure 1:
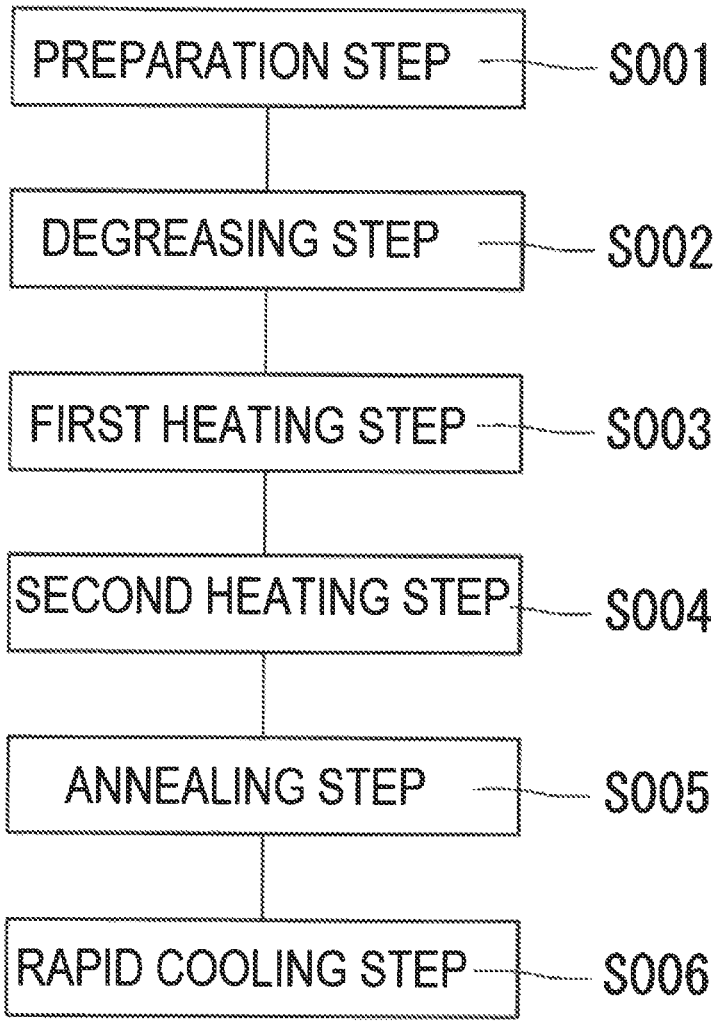
FIG. 1 is a flow chart showing procedures of a motor core production method according to an embodiment of the present invention.

As shown in FIG. 1, the production method in the present example can be a method including a preparation step S001 of preparing the laminate S of electromagnetic steel sheets each processed into a predetermined shape, a degreasing step S002 of evaporating oil content adhering to the steel sheets constituting the laminate S, a first heating step S003 of heating the laminate S at an atmospheric temperature of 500° C. to 800° C. in an atmospheric gas having a dew point of −20° C. or lower, a second heating step S004 of soaking the laminate S at 1,000° C. to 1,200° C. in a vacuum, an annealing step S005 of annealing the laminate S, and a rapid cooling step S006 of rapidly cooling the laminate S after annealing.

In the production method in the present example, by performing the series of steps, strain relief and grain growth in the laminate S can be performed at the same time. Therefore, it is desirable that the grain size (average crystal gain size) of each of the electromagnetic steel sheets prepared in the preparation step S001 is less than 100 μm from the viewpoint of processability. After performing the series of steps, the average crystal grain size of each of the electromagnetic steel sheets can he 100 μm to 300 μm, which is excellent in magnetic properties.

Figure 2:
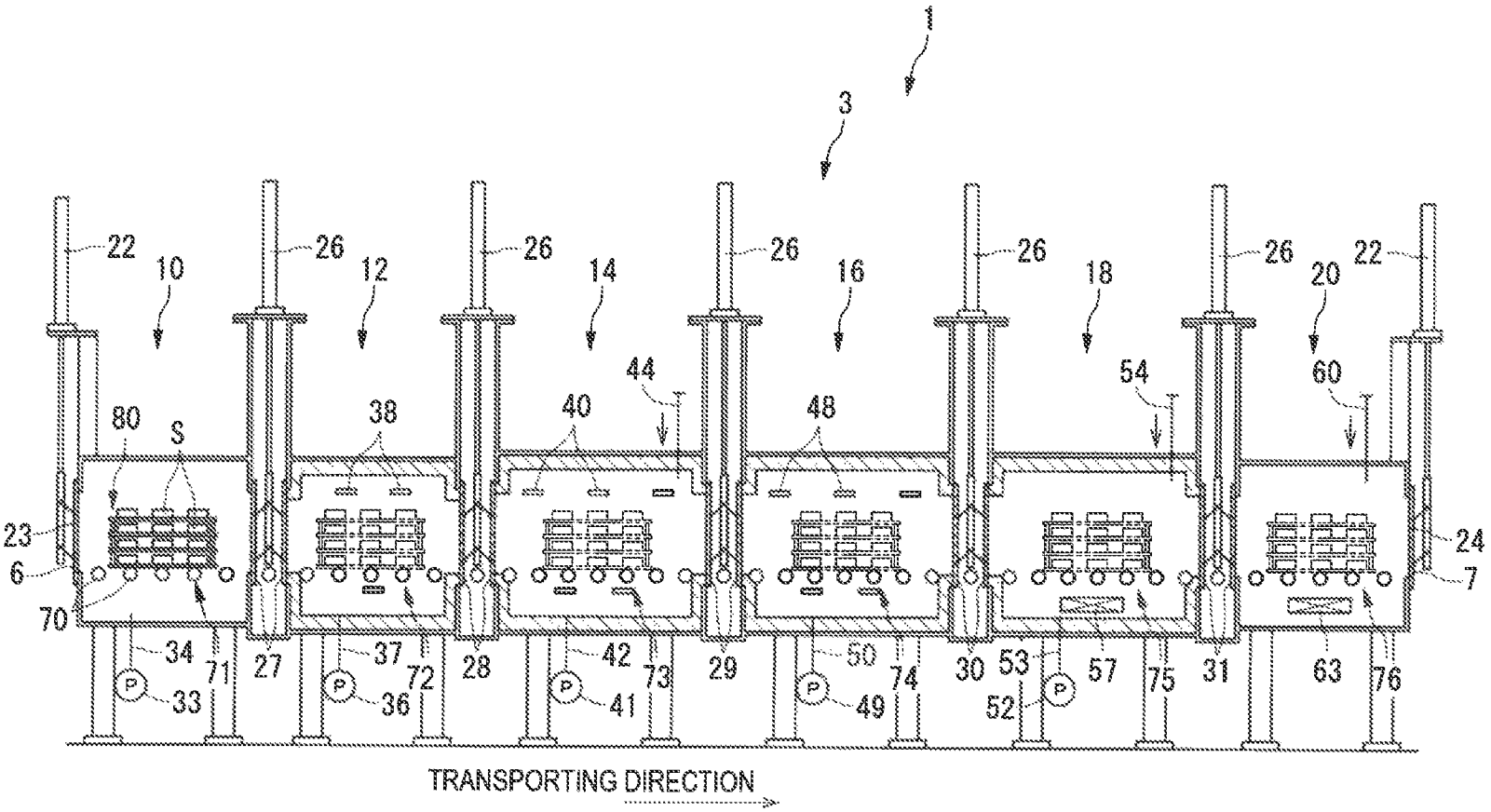
FIG. 2 is a diagram illustrating an overall configuration of a roller hearth type heat treatment device used in the production method according to the embodiment.

FIG. 2 illustrates a schematic overall configuration of a roller hearth type heat treatment device 1 used in the production method. The heat treatment device 1 performs a heat treatment continuously in a state where the laminate S of electromagnetic steel sheets is placed on a jig 80.

Figure 3A:
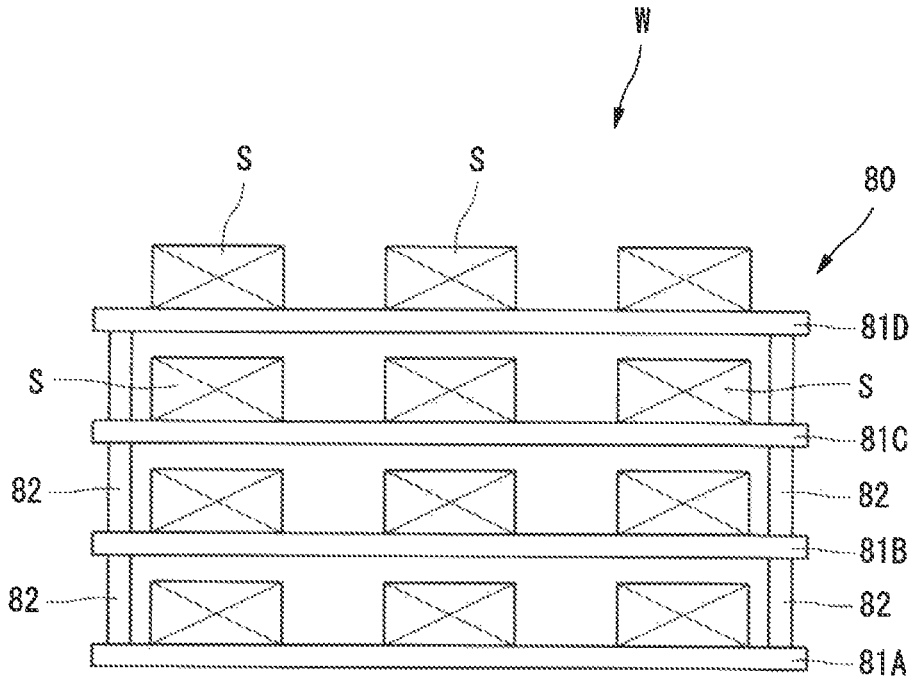
FIGS. 3A and 3B are diagrams illustrating a jig placing a laminate.
Figure 3B:
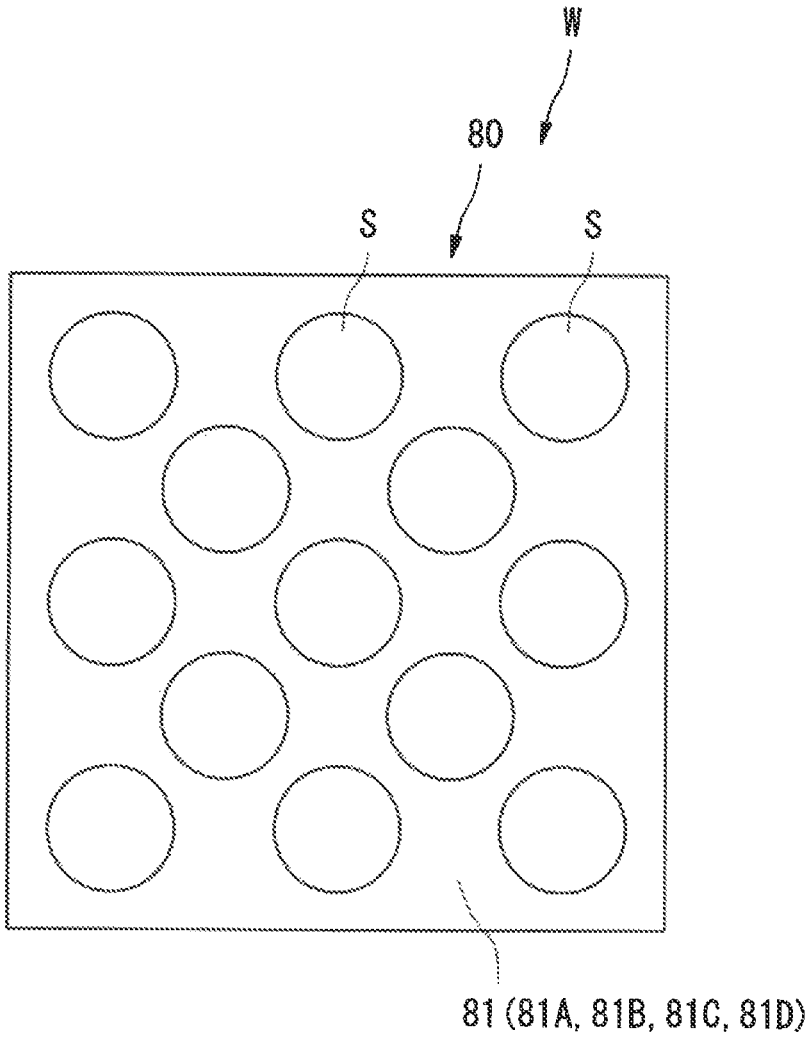

Here, as shown in FIG. 3A, the jig 80 on which the laminate S is placed includes a plurality of sheet-shaped trays 81 (81A, 81B, 81C, and 81D in this example), and short columnar spacers 82 erected at four corners of each of the trays 81A, 81B, and 81C excluding the uppermost tray 81D. As shown in FIG. 3B, a plurality of laminates S are placed on a flat upper surface of each tray 81. The laminates S and the jig 80 are transported together as a target object W.

The jig 80 in the present example is made of a C/C composite, which has high heat resistance and a small decrease in strength in a temperature range of 1,000° C. to 1,200° C. The C/C composite is a carbon composite material reinforced with high-strength carbon fiber. In the case where the laminate S is placed on a C/C composite jig, deformation of the laminate during high temperature annealing can be prevented.

Next, the configuration of the heat treatment device 1. will be described. As shown in FIG. 2, the heat treatment device 1 includes a charging inlet 6 on a left side of a furnace body 3 in FIG. 2, and a taking out outlet 7 on a right side of the furnace body 3 in FIG. 2. The inlet 6 and the outlet 7 are respectively provided with a door 23 and a door 24, each of which is driven to be opened and closed by an air cylinder type opening/closing device 22. That is, in the present example, the laminate S charged from the left side in FIG. 2 is transported to the right side in the FIG. 2.

Inside the furnace body 3, a front chamber 10, a degreasing chamber 12, a first heating chamber 14, a second heating chamber 16, an annealing chamber 18, and a rapid cooling chamber 20 are disposed in series along a direction in which the laminate S is transported. An air cylinder type opening/closing device 26 is provided between each of chambers to open and close doors 27, 28, 29, 30 and 31 of openings formed in respective chambers.

The front chamber 10 is a section which prevents air from entering the degreasing chamber 12 on a downstream side. A degassing pipe 34 connected to a vacuum pump 33 is connected to the front chamber 10, and the inside of the front chamber 10 is depressurized to a vacuum state of 100 Pa or less by the vacuum pump 33.

The degreasing chamber 12 is a section in which oil content adhering to the steel sheets (steel sheets constituting the laminate S) is evaporated in a punching step. A degassing pipe 37 connected to a vacuum pump 36 is connected to the degreasing chamber 12, and the inside of the degreasing chamber 12 is depressurized to a vacuum state of 100 Pa or less by the vacuum pump 36. In addition, an electric heater 38 is provided to heat the inside of the degreasing chamber 12 to a temperature (300° C. to 500° C.) at which degreasing can be performed. Accordingly, the laminate S housed in the degreasing chamber 12 is heated under a vacuum, and the oil content adhering to the laminate S can be evaporated. The oil vapor is discharged to the outside through the degassing pipe 37 and collected by a cold trap as required.

The first heating chamber 14 is a section in which the laminate S is annealed together with the second heating chamber 16 and the annealing chamber 18 on the downstream side. The first heating chamber 14 is internally provided with a heater 40 to heat the laminate S. In addition, a degassing pipe 42 connected to a vacuum pump 41, and an atmospheric gas supply pipe 44 are connected to the first heating chamber 14. A nitriding gas (low oxidizing gas) as the atmospheric gas having a dew point of −20° C. or lower can be supplied into the chamber through the atmospheric gas supply pipe 44.

In the first heating chamber 14, the atmospheric temperature is set to 500° C. to 800° C., and the laminate S in the first heating chamber 14 is heated by convection heat transfer heating with a nitrogen gas. By using convection heat transfer heating via a gas, the heating time for the laminate S can be shortened as compared with vacuum heating. In the case where the gas is pressurized, the heating capability can be further improved.

The C/C composite jig 80 has a problem that it is vulnerable to a high temperature oxidizing atmosphere. However, the first heating chamber 14 has an atmosphere including at least one kind selected from the group consisting of a low oxidizing gas and a reducing gas and having a dew point of −20° C. or lower, and a decrease in oxidation resistance of the C/C composite jig 80 can be prevented satisfactorily.

The second heating chamber 16 is a section in which the laminate S is soaked at 1,000° C. to 1,200° C. in a vacuum of 100 Pa or less to grow crystal grains of each of the electromagnetic steel sheets.

Therefore, the second heating chamber 16 is internally provided with an electric heater 48 to heat the laminate S. In addition, the second heating chamber 16 is connected to a degassing pipe 50 connected to a vacuum pump 49, and the inside of the second heating chamber 16 is depressurized to a vacuum state of 100 Pa or less by the vacuum pump 49.

In a high temperature atmosphere, the number of gas molecules in the atmosphere decreases, and the capability of convection heat transfer heating using a gas decreases. Therefore, in the second heating chamber 16, vacuum heating that does not require the introduction of a gas is performed in consideration of an advantage in cost.

The annealing chamber 18 is a section in which the soaked laminate S is annealed at a predetermined cooling rate.

A degassing pipe 53 connected to a vacuum pump 52, and an atmospheric gas supply pipe 54 are connected to the annealing chamber 18. A nitrogen gas as the atmospheric gas having a dew point of −20° C. or lower can be supplied into the chamber through the atmospheric gas supply pipe 54.

In addition, the annealing chamber 18 is provided with a heat exchanger 57 cooling the atmospheric gas and a fan (not shown) circulating the atmospheric gas. The atmospheric gas in the annealing chamber 18 can be cooled by the heat exchanger 57, and thereby annealing the laminate S at a predetermined cooling rate.

The rapid cooling chamber 20 is a section in which the laminate S after slow cooling is rapidly cooled. Similar to the annealing chamber 18, the rapid cooling chamber 20 is connected to an atmospheric gas supply pipe 60 and is provided with a heat exchanger 63 cooling the atmospheric gas and a fan (not shown) circulating the atmospheric gas.

In each chamber constituting the heat treatment device 1, transporting rollers 70 are disposed in parallel along the transporting direction. The rollers 70 disposed in each of the chambers, i.e., the front chamber 10, the degreasing chamber 12, the first heating chamber 14, the second heating chamber 16, the annealing chamber 18, and the rapid cooling chamber 20, constitute roller groups 71, 72, 73, 74, 75 and 76, respectively. These roller groups 71, 72, 73, 74, 75, and 76 are independently driven to sequentially convey the laminate S placed on the jig 80 to the downstream side in the transporting direction (to the right in FIG. 2).

The roller 70 can be a metal roller made of stainless steel, heat-resistant cast steel, or the like. Since deformation is likely to occur when the roller 70 is used at a temperature higher than 900° C., in the present example, the rollers 70 disposed in the first heating chamber 14, the second heating chamber 16, and the annealing chamber 18 are made of a C/C composite, which has little decrease in strength in a high temperature range.

Figure 4:
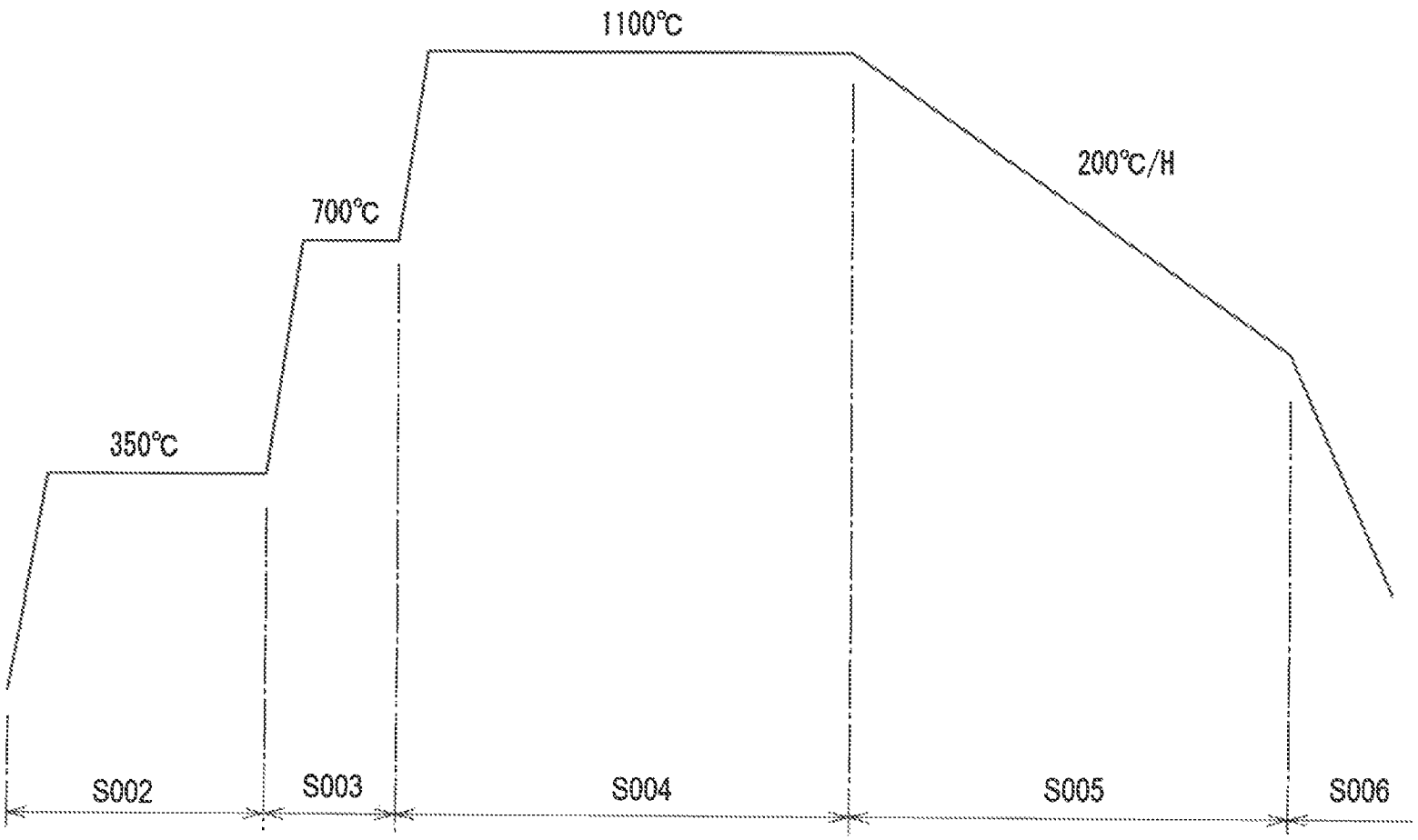
FIG. 4 is a diagram showing an example of a heat pattern in the production method according to the embodiment.

Next, a series of heat treatment operations in the heat treatment device 1 after the laminate S is charged will be described. The series of operations in the heat treatment device 1 shall be based on a heat pattern in FIG. 4.

First, the laminate S is prepared in a state of being placed on the jig 80.

Then, the roller group 71 is driven to charge the laminate S into the front chamber 10. When the door 23 is closed, the air inside the chamber is discharged to the outside by the vacuum pump 33, and the inside of the front chamber 10 is depressurized to a vacuum pressure same as that of the degreasing chamber 12.

Thereafter, the door 27 on an outlet side of the front chamber 10 and the door 27 on an inlet side of the degreasing chamber 12 are opened, the roller groups 71 and 72 are driven to transport the laminate S into the degreasing chamber 12, and the door 27 is closed. The inside of the degreasing chamber 12 is retained in advance at a temperature at which degreasing can be performed (here, 350° C.), the laminate S charged into the degreasing chamber 1 is heated to 350° C., which is the temperature at which degreasing can be performed, and the oil content adhering to the laminate S is evaporated.

Thereafter, in a state where the inside of the degreasing chamber 12 and the inside of the first heating chamber 14 are depressurized to the same degree of a vacuum pressure, the door 28 on an outlet side of the degreasing chamber 12 and the door 28 on an inlet side of the first heating chamber 14 are opened, the roller groups 72 and 73 are driven to transport the laminate S into the first heating chamber 14, and the door 28 is closed.

The inside of the first heating chamber 14 is retained in advance at a predetermined set temperature (here, 700° C.), and the laminate S charged into the first heating chamber 14 is heated to 700° C., which is the set temperature of the first heating chamber 14. At this time, in order to promote the temperature rise, a nitrogen gas is supplied into the first heating chamber 14, and the temperature rise of the laminate S is promoted by convection heat transfer heating by using the nitrogen gas and heat radiation from the heater 40.

When the laminate S is heated to the set temperature of about 700° C., the nitrogen gas in the first heating chamber 14 is evacuated, and the inside of the first heating chamber 14 is depressurized to a vacuum pressure (100 Pa or less) same as the inside of the second heating chamber 16. The door 29 on an outlet side of the first heating chamber 14 and the door 29 on an inlet side of the second heating chamber 16 are opened, the roller groups 73 and 74 are driven to transport the laminate S into the second heating chamber 16, and the door 29 is closed.

The inside of the second heating chamber 16 is retained in advance at a predetermined set temperature (here, 1,100° C.), the laminate S charged into the second heating chamber 16 is heated to a set temperature by heat radiation from the heater 48 in a vacuum of 100 Pa or less, and then the temperature is retained.

After the temperature is retained for a predetermined time, the door 30 on an outlet side of the second heating chamber 16 and the door 30 on an inlet side of the slow cooling chamber 18 are opened, the roller groups 74 and 75 are driven to transport the laminate S into the annealing chamber 18, and the door 30 is closed.

In the annealing chamber 18, the laminate S is annealed to 500° C. at an average cooling rate of 200° C./H by convection heat transfer with a nitrogen gas supplied into the annealing chamber 18.

After annealing, the door 31 on an outlet side of the annealing chamber 18 and the door 31 on an inlet side of the rapid cooling chamber 20 are opened, the roller groups 75 and 76 are driven to transport the laminate S into the rapid cooling chamber 20, and the door 31 is closed.

In the rapid cooling chamber 20, the laminate S is cooled by circulating the atmospheric gas while cooling the atmospheric gas with the heat exchanger 63. Then, after cooling, the door 24 is opened, and the laminate S is taken out of the chamber. Thus, a series of operations related to the heat treatment for the laminate S is completed.

As described above, according to the motor core production method using the heat treatment device 1 of the present embodiment, through a series of heat treatments including the first heating step S003 and the second heating step S004, the laminate S is heated to a temperature (1,000° C. to 1,200° C.) at which grain growth can be performed, so that strain relief and grain growth in the laminate S can be performed at the same time.

In addition, in the production method, the laminate S is heated in two stages, that is, convection heat transfer heating by using the atmospheric gas having a dew point of −20° C. or lower and subsequent vacuum heating, and the laminate S can be efficiently heated to a temperature at which grain growth can be performed while oxidation of the laminate S is prevented.

Here, in the temperature range of 1,000° C. to 1,200° C., the rigidity of the laminate S during the treatment is lowered and the shape is likely to change. In the present embodiment, the heat treatment is performed in a state where the laminate S is placed on the C/C composite jig 80, whereby the deformation of the laminate S can be prevented.

According to the production method of the present embodiment, strain relief and grain growth in the laminate S can be performed at the same time. Therefore, the average crystal grain size of each of the electromagnetic steel sheets before the first heating step can be less than 100 μm, and with grain growth of this, the average crystal grain size of each of the electromagnetic steel sheets after the second heating step can be 100 μm to 300 μm, which is excellent in magnetic properties.

Next, a heat treatment device 1B according to another embodiment of the present invention will be described.

Figure 5:
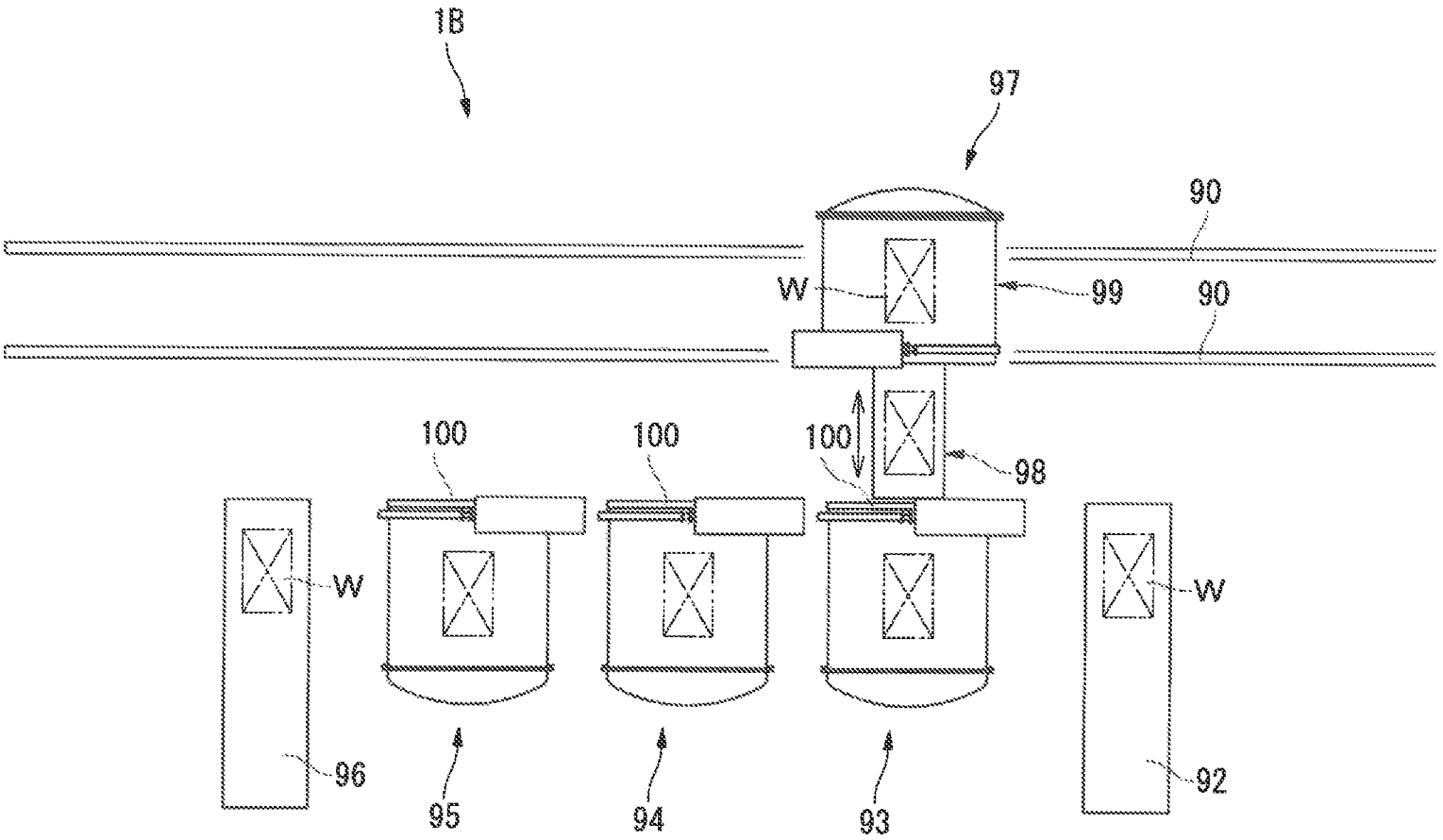
FIG. 5 is a diagram illustrating an overall configuration of a heat treatment device according to another embodiment of the present invention.

FIG. 5 is a diagram illustrating an overall configuration of the heat treatment device 1B. In FIG. 5, reference numeral 90 denotes a rail as a transport track extending linearly in a horizontal direction in FIG. 5. A plurality of batch-type treatment chambers (here, a degreasing chamber 93, a heating chamber 94, and a cooling chamber 95) are linearly disposed in a line along the rail 90 with opening portions 100 facing the same direction, i.e., facing upward in FIG. 5. In FIG. 5, a charging table 92 is provided on a right end side, and an extraction table 96 is provided on a left end side.

In the heat treatment device 1B, on the target object W including the laminates S and the jig 80 (see FIGS. 3A and 3B), a degreasing step (see FIG. 1) is performed in the degreasing chamber 93, a first heating step and a second heating step (see FIG. 1) are performed in the heating chamber 94, and an annealing step and a rapid cooling step (see FIG. 1) are performed in the cooling chamber 95.

The heat treatment device 1B in the present example includes a transport unit 97 running on the rails 90, in addition to the degreasing chamber 93, the heating chamber 94, and the cooling chamber 95 described above. The transport unit 97 includes a transfer chamber 98 and a temperature-retaining chamber 99, and transfers the target object W between the charging table 92, the treatment chambers 93, 94 and 95, and the extraction table 96.

Figure 6:
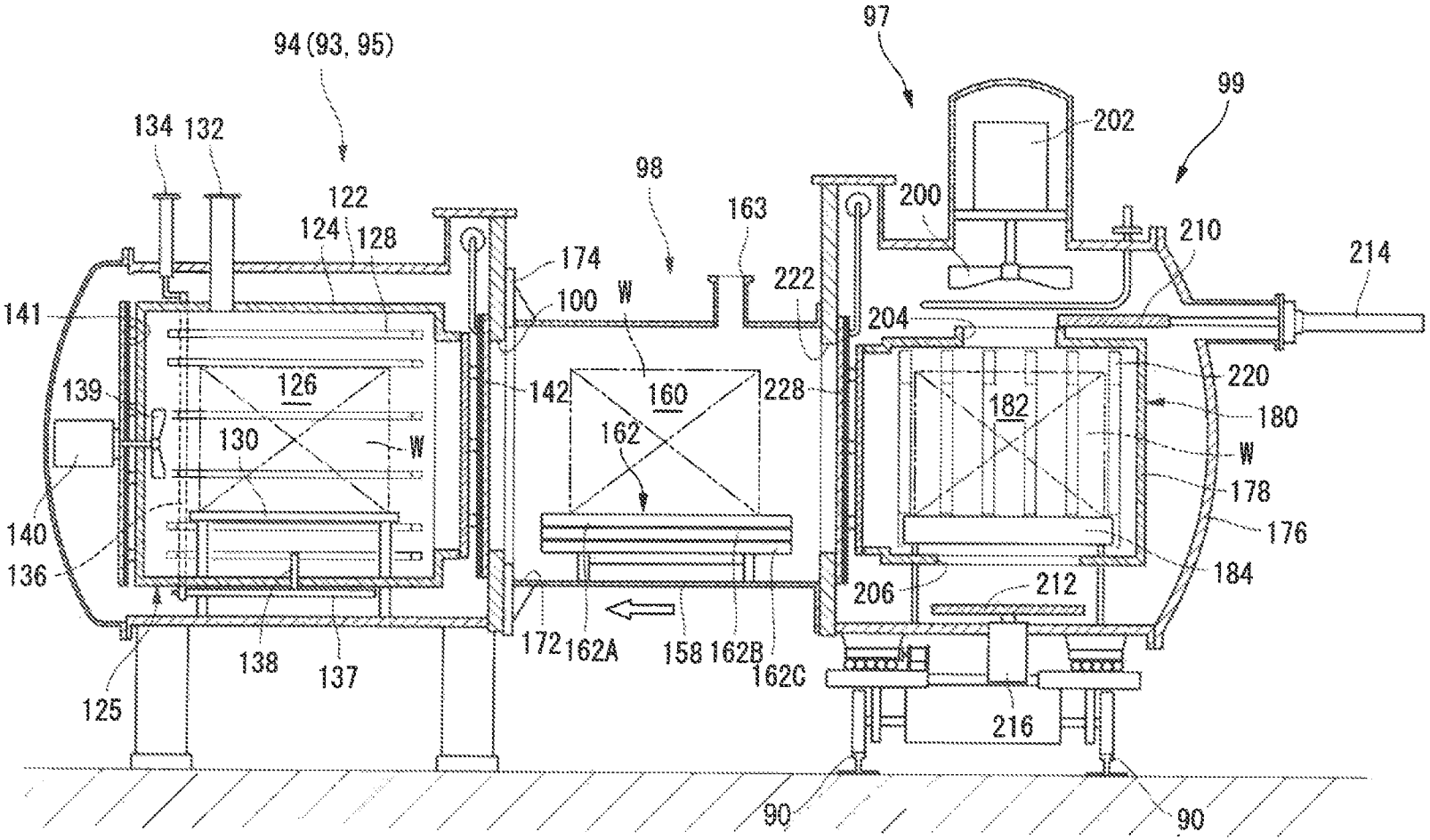
FIG. 6 is a diagram illustrating an internal structure of a heating chamber and a transport unit in FIG. 5.

FIG. 6 illustrates an internal structure of the heating chamber 94 and the transport unit 97.

As shown in FIG. 6, the heating chamber 94 includes a bottomed cylindrical furnace shell 122 and a heat insulating material 124 disposed therein. The heat insulating material 124 constitutes a bottomed cylindrical heat insulating wall 125. The heat insulating wall 125 forms a treatment chamber 126 therein.

The heating chamber 94 is provided with a suction port 132. The suction port 132 is connected to a vacuum pump (not shown) through a suction pipe, and the inside of the heating chamber 94 is vacuum-sucked by the vacuum pump.

In addition, the heating chamber 94 is internally provided with a supply port 134 supplying a nitrogen gas (low oxidizing gas) as the atmospheric gas having a dew point of −20° C. or lower. The nitrogen gas supplied through the supply port 134 is once led to a header 136, and is further introduced into the inside of the heating chamber 94, more specifically, into the treatment chamber 126 inside the heat insulating wall 125, through a branch pipe 137 following the header 136 and a nozzle 138 provided in the branch pipe 137.

The heat insulating wall 125 is provided with a convection fan 139 which agitates the nitrogen gas supplied into the treatment chamber 126 to cause convection and accelerates the temperature rise of the target object during the temperature rise period, and a motor 140 rotating the convection fan 139. In addition, on the heat insulating wall 125, a water cooling panel 141 protecting the motor 140 from heat is included near the motor 140. Further, the inside of the treatment chamber 126 is provided with a heater 128 heating the chamber.

The treatment chamber 126 is provided with a. pedestal 130. The target object in the treatment chamber 126 is placed and supported on the pedestal 130. The heating chamber 94 is also provided with a sliding door 142 opening and closing the opening portion 100.

The structure of the heating chamber 94 has been described above, and the degreasing chamber 93 and the cooling chamber 95 have basically the same structure. However, the cooling chamber 95 is internally provided with a heat exchanger (not shown) which lowers the temperature of the atmospheric gas by heat exchange.

The transport unit 97 includes the transfer chamber 98 in front of the treatment chambers 93, 94, and 95, and the temperature-retaining chamber 99 retaining the temperature of the target object W at the rear on the opposite side.

The transfer chamber 98 includes a pressure-resistant rectangular tubular wall 158, and the inside thereof forms a housing chamber 160 in which the target object W is housed. The housing chamber 160 is provided with a transfer mechanism 162.

The transfer mechanism 162 transfers the target object W between the treatment chambers 93, 94, and 95 and the temperature-retaining chamber 99 at the rear, and includes a fork portion 162A and horizontal slide members 162B and 162C. By sliding the slide members 162B and 162C in the horizontal direction, the target object is transferred by the fork portion 162A.

The transfer chamber 98 is provided with a suction port 163. This suction port 163 is connected to a vacuum pump 164 shown in FIG. 7 through a suction pipe 166A, and the inside of the transfer chamber 98 is vacuum-sucked by the vacuum pump 164.

The suction pipe 166A is provided with an opening/closing valve 168A including an electromagnetic valve. By opening and closing the opening/closing valve 168A, the suction port 163 and the vacuum pump 164 are communicated with and disconnected from each other.

Figure 7:
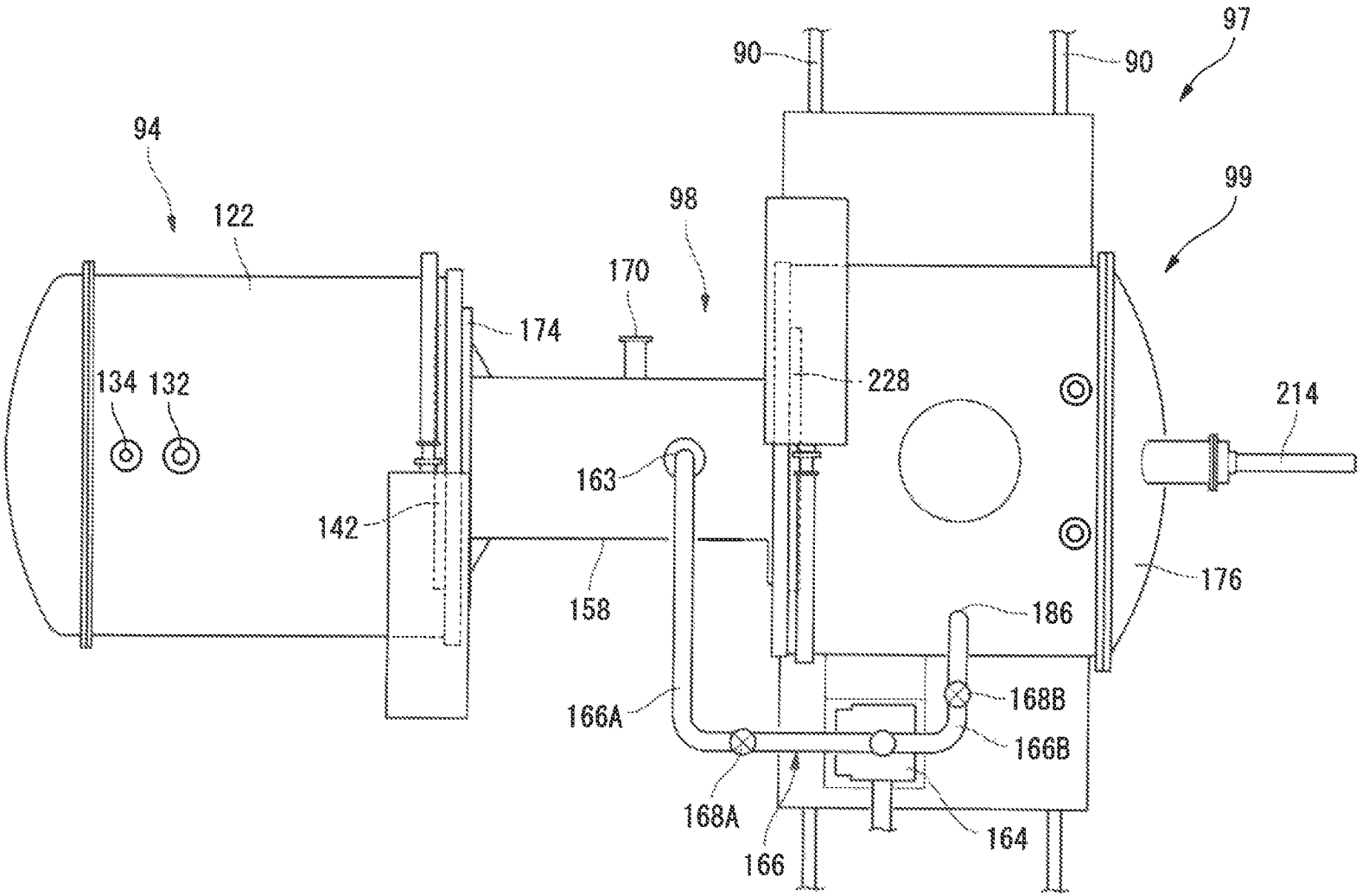
FIG. 7 is a plan view of the heating chamber and the transport unit.

The transfer chamber 98 is also provided with a supply port 170 as shown in FIG. 7. A nitrogen gas is supplied into the transfer chamber 98 through this supply port 170. The transfer chamber 98 includes an opening portion 172 with no door at a front end thereof, i.e., a left end in FIG. 6. A flat frame-shaped packing 174 is provided around the opening portion 172 in the transfer chamber 98. The transfer chamber 98 is docked to each of the treatment chambers 93, 94, and 95 by a forward movement toward the treatment chambers 93, 94, and 95 so that the frame-shaped packing 174 is in airtight contact with outer surfaces of each of the treatment chambers 93, 94 and 95.

On the other hand, the temperature-retaining chamber 99 includes a heat insulating material 178 inside a bottomed cylindrical furnace shell 176, and the heat insulating material 178 constitutes a heat insulating wall 180. The heat insulating wall 180 forms a housing chamber 182 therein, in which the target object W is housed. The housing chamber 182 is provided with a pedestal 184. The target object W in the housing chamber 182 is placed and supported on the pedestal 184.

As shown in FIG, 7, the temperature-retaining chamber 99 is provided with a suction port 186 vacuum-sucking the inside of the temperature-retaining chamber 99, and the suction port 186 is connected to the vacuum pump 164 through a suction pipe 166B. The suction pipe 166B is provided with an opening/closing valve 168B including an electromagnetic valve. By opening and closing the opening/closing valve 168B, the suction port 186 and the vacuum pump 164 are communicated with and disconnected from each other.

The temperature-retaining chamber 99 is provided with a heater 220 retaining the temperature of the target object W inside the heat insulating wall 180. As shown in FIG. 6, the temperature-retaining chamber 99 is provided with doors 210 and 212 made of a heat insulating material which open and close an upper opening 204 and a lower opening 206 of the heat insulating wall 180. The doors 210 and 212 are opened and closed by cylinders 214 and 216.

In addition, the temperature-retaining chamber 99 includes a supply port (not shown) which supplies a nitrogen gas as a cooling gas to the inside of the chamber in the furnace shell 176. In addition, the temperature-retaining chamber 99 includes therein a heat exchanger (not shown) which lowers the temperature of the supplied nitrogen gas by heat exchange, a cooling fan 200 which agitates and circulates the nitrogen gas within the temperature-retaining chamber 99, and a motor 202 which rotates the cooling fan 200, which constitute a gas cooling device for the target object W.

That is, in the present embodiment, the temperature-retaining chamber 99 has a temperature-retaining function retaining the temperature of the target object W, and also has a cooling function.

As shown in FIG. 6, an opening portion 222 is provided between the temperature-retaining chamber 99 and the transfer chamber 98, more specifically, at an end portion of the transfer chamber 98 side on the temperature-retaining chamber 99. This opening portion 222 is opened and closed by a door 228.

Next, a series of heat treatment operations in the heat treatment device 1B will be described. The series of operations in the heat treatment device 1B shall be based on the beat pattern in FIG. 4. When transferring the target object W between the transport unit 97 and each of the treatment chambers 93, 94 and 95, the target object W is transferred in a state where both atmospheres (low dew point atmosphere and vacuum) match each other.

First, the target object W on the charging table 92 in FIG. 5 is received and transported by the transport unit 97, and is then charged into the degreasing chamber 93. The degreasing chamber 93 that receives the target object W performs degreasing the target object W therein.

Thereafter, the transport unit 97 takes out the target object W after degreasing from the degreasing chamber 93, retains the temperature of the target object W in the temperature-retaining chamber 99, and then charges the target object W into the heating chamber 94. The heating chamber 94 that receives the target object W heats and soaks the target object W.

Specifically, when the target object W is charged into the heating chamber 94, the heater 128 heats the target object W to about 700° C., which is the set temperature in the first heating step.

At this time, in order to promote the temperature rise, a nitrogen gas is supplied through the supply port 134 into the heating chamber 94, the convection fan 139 is rotated, and the target object W is quickly heated to about 700° C. by the convection heating with the convection fan 139 and the radiant heat with the heater 128.

When the target object W is heated to about 700° C., the nitrogen gas inside the heating chamber 94 is evacuated through the suction port 132, and the heating chamber 94 is depressurized to a set vacuum pressure (100 Pa or less). Then, vacuum heating is continuously performed by the heater 128 in a vacuum of 100 Pa or less, and the target object W is soaked at 1,100° C.

When the heating and soaking treatment is completed, the transport unit 97 takes S out the target object W from the heating chamber 94, retains the temperature of the target object W in the temperature-retaining chamber 99, and transfers the target object W to the cooling chamber 95.

The cooling chamber 95 that receives the target object W anneals the target object at a predetermined cooling rate. At this time, a nitrogen gas is supplied through the supply port 134 into the cooling chamber 95, the convection fan 139 is rotated, and the target object W is cooled (annealed) at a predetermined cooling rate by convection heat transfer with the convection fan 139.

After cooling, the transport unit 97 takes out the target object W from the cooling chamber 95 and discharges the target object W onto the extraction table 96. Accordingly, the heat treatment for the target object W including the laminate S is completed.

As described above, in the case of using the heat treatment device 1B, the motor core production method according to the present embodiment can also be performed. In the heat treatment device 1B, the first heating step and the second heating step are performed in one heating chamber 94. Alternatively, the first heating step and the second heating step may be performed in separate heating chambers. In the heat treatment device 1B, the annealing step and the rapid cooling step are performed in one cooling chamber 95.

Alternatively, the annealing step and the rapid cooling step may be performed in separate cooling chambers.

In addition, the temperature-retaining chamber 99 in the present example has a cooling function, and it is also possible to perform a part of the annealing step or the rapid cooling step in the temperature-retaining chamber 99.

Although the embodiment of the present invention has been described in detail above, this is merely an example. For example, in the above embodiment, a nitrogen gas (low oxidizing gas) is used as the atmospheric gas including at least one kind selected from the group consisting of a low oxidizing gas and a reducing gas and having a dew point of −20° C. or lower. Alternatively, a hydrogen may be used instead of a nitrogen gas when the grain growth in the laminate is hindered due to the generation of a nitrogen compound in the high temperature gas containing nitrogen. In addition, it is also possible to use a mixed gas as the atmospheric gas, and examples of the mixed gas include nitrogen gas+hydrogen gas, nitrogen gas+carbon monoxide gas, and nitrogen gas+hydrogen gas carbon monoxide gas. The present invention can be configured so as to include such and other various modifications unless the modifications depart from the spirit of the invention.

The present application is based on Japanese Patent Application No. 2022-008231 filed on Jan. 21, 2022, and the contents thereof are incorporated herein by reference.

1, 1B heat treatment device
14 first heating chamber
16 second heating chamber
18 annealing chamber
70 roller
80 jig
94 heating chamber
95 cooling chamber
97 transport unit
98 transfer chamber
99 temperature-retaining chamber
S laminate
S001 preparation step
S003 first heating step
S004 second heating step
W target object

What is claimed is:

1. A motor core production method comprising:

a preparation step of preparing a laminate of electromagnetic steel sheets each processed into a predetermined shape;

a first heating step of heating the laminate at an atmospheric temperature of 500° C. to 800° C. in an atmospheric gas comprising at least one selected from the group consisting of a low oxidizing gas and a reducing gas, and having a dew point of −20° C. or lower; and a second heating step of soaking the laminate at 1,000° C. to 1,200° C. in a vacuum of 100 Pa or less after the first heating step.

2. The motor core production method according to claim 1, wherein the laminate is heat-treated in a state of being placed on a jig made of a C/C composite.

3. The motor core production method according to claim 1, wherein the low oxidizing gas is nitrogen gas, and the reducing gas is at least one selected from the group consisting of hydrogen gas and carbon monoxide gas.

4. The motor core production method according to claim 1, wherein each of the electromagnetic steel sheets before the first heating step has an average crystal grain size of less than 100 μm.

5. The motor core production method according to claim 4, wherein the each of electromagnetic steel sheets after the second heating step has an average crystal grain size of 100 μm to 300 μm.

6. The motor core production method according to claim 1, further comprising a degreasing step of evaporating oil content adhering to the electromagnetic steel sheets constituting the laminate, wherein the degreasing step is performed before the first heating step.

7. The motor core production method according to claim 6, wherein the degreasing step comprises heating the laminate at 300° C. to 500° C. in a vacuum of 100 Pa or less.

8. The motor core production method according to claim 1, further comprising an annealing step of annealing the laminate after the second heating step.

9. The motor core production method according to claim 8, wherein the annealing step comprises cooling the laminate at a predetermined cooling rate.

10. The motor core production method according to claim 8, further comprising a rapid cooling step of rapidly cooling the laminate after the annealing step.

11. The motor core production method according to claim 1, wherein the atmospheric gas in the first heating step is a mixed gas comprising nitrogen gas and at least one selected from the group consisting of hydrogen gas and carbon monoxide gas.

12. The motor core production method according to claim 1, wherein the first heating step comprises heating the laminate at an atmospheric temperature of 600° C. to 750° C.

13. The motor core production method according to claim 1, wherein the second heating step comprises soaking the laminate at 1,050° C. to 1,150° C.

14. The motor core production method according to claim 1, wherein the atmospheric gas in the first heating step has a dew point of −30° C. or lower.

15. The motor core production method according to claim 1, wherein the vacuum in the second heating step is 10 Pa or less.

16. The motor core production method according to claim 1, wherein the laminate is a rotor core or a stator core.

17. The motor core production method according to claim 1, wherein the electromagnetic steel sheets are non-oriented electromagnetic steel sheets.

18. The motor core production method according to claim 2, wherein the jig comprises a plurality of sheet-shaped trays and spacers erected at corners of the trays, and wherein a plurality of laminates are placed on each tray.

* * * * *